US005944399A

United States Patent [19]

Gillispie

[11] Patent Number: 5,944,399

[45] Date of Patent: Aug. 31, 1999

[54] SAFETY CABINET WITH SELF-CLOSING AND SEQUENCING DOOR MECHANISM

[75] Inventor: John G. Gillispie, Glen Dale, W. Va.

[73] Assignee: Eagle Manufacturing Company, Wellsburg, W. Va.

[21] Appl. No.: 09/111,267

[22] Filed: Jul. 6, 1998

[51] Int. Cl.[6] ..... A47B 88/00

[52] U.S. Cl. ..... 312/324; 49/103; 49/367

[58] Field of Search ..... 312/324, 326, 312/329, 319.5, 319.6, 319.8, 295, 223.1; 49/103, 104, 122, 366, 367

[56] References Cited

U.S. PATENT DOCUMENTS

| | | | |
|---|---|---|---|
| 881,477 | 3/1908 | Lovell | 49/103 X |
| 1,824,109 | 9/1931 | Allard et al. | 49/103 |
| 3,422,573 | 1/1969 | Rich | 49/104 X |
| 3,822,506 | 7/1974 | Fishbach | 49/367 |
| 3,895,461 | 7/1975 | Maynard, Jr. et al. | 49/367 |
| 3,895,849 | 7/1975 | Zehr | 312/324 |
| 4,146,994 | 4/1979 | Williams | 49/367 |
| 4,262,448 | 4/1981 | Flider | 49/367 |
| 4,265,051 | 5/1981 | Williams | 49/7 |
| 4,429,492 | 2/1984 | Imhoff | 49/367 |
| 4,583,324 | 4/1986 | Storz et al. | 49/367 |
| 4,619,076 | 10/1986 | Livingston | 49/367 |
| 4,653,229 | 3/1987 | Feucht et al. | 49/367 |
| 4,949,505 | 8/1990 | Cohrs | 49/367 |
| 4,967,512 | 11/1990 | Schroder et al. | 49/367 |
| 5,061,022 | 10/1991 | Meriwether | 312/324 |
| 5,582,472 | 12/1996 | Lyons et al. | 312/324 |
| 5,651,216 | 7/1997 | Tillmann | 49/367 |

FOREIGN PATENT DOCUMENTS

| | | | |
|---|---|---|---|
| 18202 | 11/1904 | Germany | 49/104 |
| 507185 | 9/1930 | Germany | 49/103 |

*Primary Examiner*—Peter M. Cuomo
*Assistant Examiner*—James O. Hansen
*Attorney, Agent, or Firm*—Armstrong Westerman Hattori McLeLand & Naughton

[57] ABSTRACT

A safety cabinet for the storage of flammable or combustible materials has doors designed to automatically close in a specified sequence. The door sequencing device has three components: a stop bracket mounted to one door, a cam bracket mounted to the other door and a slide bar with a roller on one end mounted to the inside surface of the top of the safety cabinet. The slide bar is operably associated with the two brackets such that it blocks the movement of the stop bracket on one door until the cam bracket of the other door engages the roller and removes the slide bar from the path of the stop bracket thereby allowing the second door to close.

9 Claims, 4 Drawing Sheets

SAFETY CABINET WITH SELF-CLOSING AND SEQUENCING DOOR MECHANISM

FIELD OF THE INVENTION

The present invention relates generally to safety cabinets for storage of combustibles or volatiles and more specifically to safety cabinets having a self-closing and sequencing door mechanism.

BACKGROUND OF THE INVENTION

The present invention is a safety cabinet having a self-closing and sequencing door mechanism. It is very important for safety cabinets storing flammable, volatile or explosive materials to have doors which automatically close in a tight fit and are flush with the edges of the safety cabinet. A tight and flush fit is necessary to completely seal off the inside of the safety cabinet from the outside thereby protecting the contents from an external hazard or conversely protecting the outside surrounding area from an internal hazard. Safety storage cabinets are desirably constructed such that the doors automatically close after opening in order to assure that the flammable, volatile or explosive material remaining within the cabinet are not exposed. Safety cabinets so constructed reduce the risk of danger in storing hazardous materials.

A majority of door sequencing devices in the art operate on the principle of having a blocking means for holding one door open while allowing a second door to completely close thereby triggering a mechanism to remove the blocking means from the first door. The mechanics of this operating principle usually involves a series of parts to translate vertical motion of the closing door into horizontal motion for removing a blocking means from a different door. Most of the devices in the art use a lever or series of levers and a bellcrank to effectuate the closing of doors in a specified sequence. With exception to the conventional lever door sequencing means are, among others, U.S. Pat. No. 4,265,051 (1981) which uses a pivotable prop located in a contacting arrangement with both doors at the edge opposite the door hinge of each door in order to coordinate the closing movement of the doors. Another device which operates with exception to the lever system is that described in U.S. Pat. No. 4,967,512 (1990), requiring the movement of guide rollers along a cross beam or track on the fixed frame of the cabinet to control the closing sequence of the doors.

Most devices however, including the present invention, operate on the principle of blocking the closure of one door while allowing the other door, usually a door with a sealing flange or lip, to securely close before removing the blocking means. Illustrative of this typical arrangement is U.S. Pat. No. 3,895,461 (1975) which describes a blocking lever biased by a member connected to a second lever which can be moved by the closing of the first door. Upon the closing of the first door, a trigger lever is pivoted which causes the biasing member to move from its extended position to its retracted position thereby allowing the blocking lever to close followed by the door. The disadvantage of this system is that it involves multiple moving parts. Another similar device is described in U.S. Pat. No. 4,949,505 (1990) which involves a blocking lever and trigger lever connected to a actuating link which is connected to a secondary link or rod which holds a biasing member against the blocking lever. This particular sequencing device has even more moving parts as well as uses a larger quantity of material to effectuate door sequencing. Actuating arms and levers or bellcranks and levers are other popular means for blocking one door while simultaneously capturing the vertical motion of the other door to remove the blocking means. The preferred embodiment of U.S. Pat. No. 4,262,448 (1981) utilizes an actuating lever arm pivotally mounted to a timing slide bracket, essentially a blocking lever, which is removed from blocking one door when the other door contacts the actuating arm. An even more complicated system of levers is disclosed in U.S. Pat. No. 5,061,022 (1991). This system involves two protruding levers interconnected by an actuating link. The actuating link is connected to one lever by a bellcrank and the second lever by a pin and notch arrangement. The action of the closing door on the lever connected to the bellcrank translates the motion of the door to the actuating link which disengages the pin from the notch in the second lever allowing the other door to close.

U.S. Pat. No. 3,895,849 (1975) discloses a different arrangement for two levers and a sliding bar or link. In this case the levers or actuating means are connected to the doors with at least one being pivotally secured to one of the doors. The actuating means contacts a sliding bar at the rear of the cabinet. The bar is positioned such that the pivotally secured actuating means is blocked from further movement until the actuating means contacts a bellcrank on the slide bar to remove it from contact from the pivotally secured actuating means. Finally, U.S. Pat. No. 3,822,506 (1974) utilizes a plunger connected to a spring link which biases a lever which holds one door open. The first door contacts the plunger which allows the spring link to move into its retracted position removing the bias from the holding lever allowing the second door to close.

The interconnected lever systems, pivotally secured actuating means and plunger and spring lever means have several disadvantages. These door sequencing mechanisms have a large number of moving parts, use a lot of material in their construction and are intricate and costly to manufacture and install into safety cabinets. Actuating links and pivotal members must be individually manufactured and then connected to each other followed by installation of all the parts in an organized arrangement. These design arrangements are costly and time consuming to build. The unique and simplified design of the present invention overcomes the problems plaguing the sequencing mechanisms in the safety cabinet art.

OBJECTS OF THE INVENTION

It is the principal object of the present invention to provide fire-proof safety cabinets having door self-closing devices which automatically close in the proper sequence.

It is another object of the present invention to provide safety cabinets with self-closing and sequencing mechanisms that are of simple and reliable construction.

It is yet another object of the present invention to provide self-closing and sequencing door mechanisms with very few moving parts.

It is still another object of the present invention to provide self-closing and sequencing door mechanisms in forms simple and economical to manufacture.

Other objects, features and advantages of the present invention will become apparent from the following detailed description taken in conjunction with the accompanying drawings.

SUMMARY OF THE INVENTION

In accordance with one embodiment of the present invention a self-closing and sequencing door mechanism is included in a safety cabinet having two doors, each hingedly mounted to an opposite side wall and connected to an automatic door closing mechanism on the inside face of the door. The self-closing and sequencing door mechanism of the present invention has a simplified design of sturdy construction and only three moving parts.

The sequencing device has three main components which are not connected to each other. The first component is a cam-shaped bracket fixedly mounted on the interior surface of a first door. The cam-shaped bracket is positioned around the midpoint of the length of the first door, preferably between the midpoint and the hingedly mounted edge. The second component is a single piece stop bracket fixedly mounted on the interior surface of the second door positioned near the midpoint of the length of the second door, preferably between the midpoint and the hingedly mounted edge. Both of these components are single pieces having no movement. These two brackets may be small in size as they interact with the third component of the device which is mounted on the front part of the inside surface of the top wall of the safety cabinet.

The third component is a slide bar movably mounted on the inside surface of the top wall adjacent the open front of the safety cabinet. This is the only component with moving parts. The movable slide bar itself is attached to a slide bar mount by a spring. One end of the slide bar is bare while the other end has a rotating roller attached.

When the slide bar is in its rest or relaxed position it blocks the closure of the door having the stop bracket mounted on its inside surface. The stop bracket is long enough so that it contacts the bare end of the slide bar thereby keeping the door it is mounted to in an open position. With one door in the open position, the other door, having a sealing flange, is allowed to pass by and close and the cam-shaped bracket fixedly mounted to this door contacts the roller at the other end of the slide bar. As a result of the motion of the cam bracket on the roller, the slide bar is removed from the path of the stop bracket allowing the door with the stop bracket to subsequently close.

DETAILED DESCRIPTION OF THE INVENTION

Figure 1:
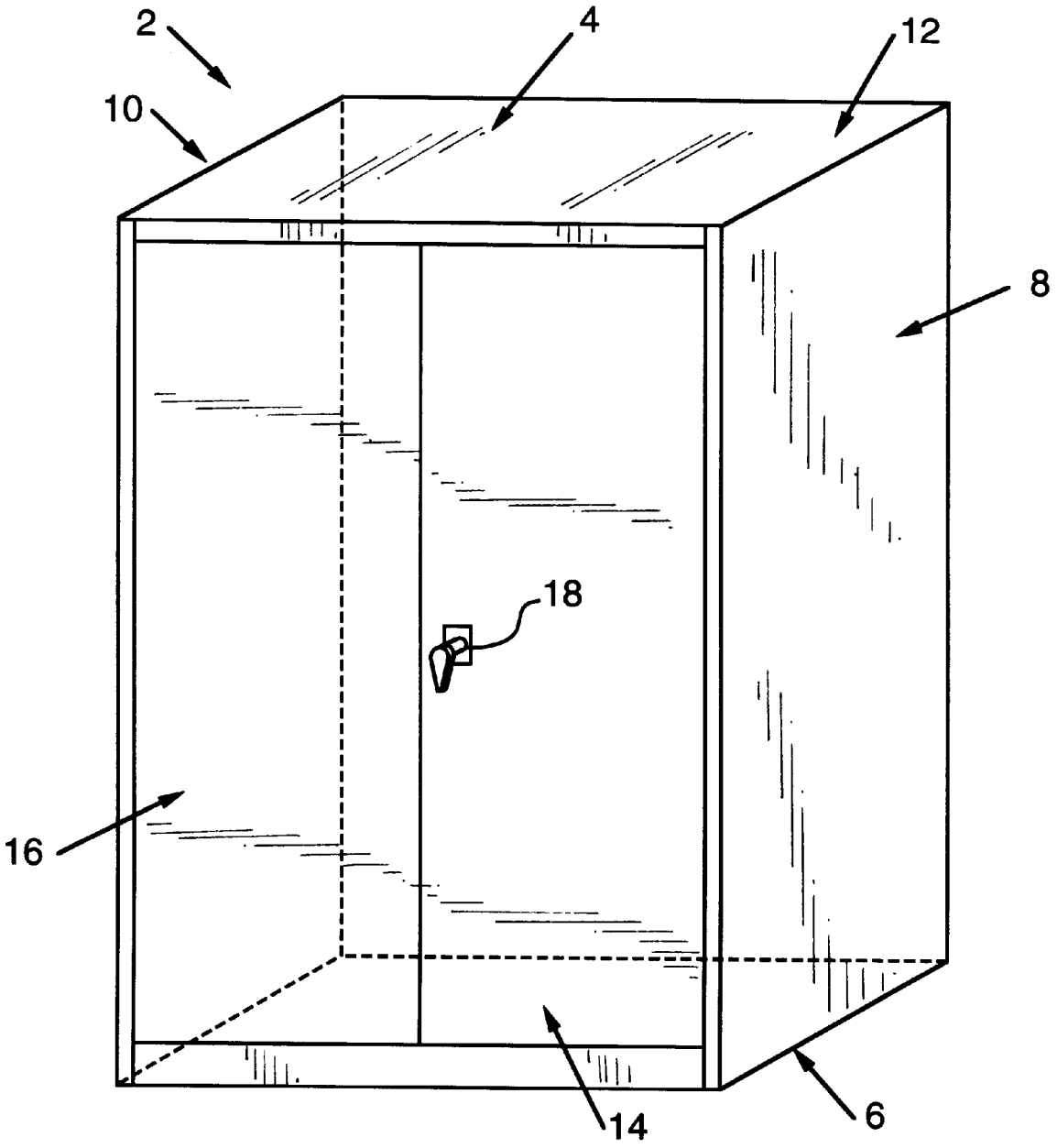
FIG. 1 is an isometric frontal view of a safety cabinet.

There is shown in FIG. 1 a fire-proof safety cabinet 2 having an outer top wall 4, an outer bottom wall 6, an outer right wall 8, an outer left wall 10, an outer rear wall 12, a right door 14 and a left door 16. Right door 14 has handle assembly 18 extending through the outside of right door 14 to allow for the opening of right door 14. Throughout the description of the preferred embodiment, the doors are designated right and left to be consistent with the drawings. This designation is arbitrary for purposes of the design of the door sequencing mechanism. Any components attached to the right door may be attached to the left and vica versa.

In keeping with one preferred construction of fire-proof safety cabinets, safety cabinet 2 is a double-walled construction, wherein each said wall has a corresponding inner wall, with said inner and outer walls separated by dead air space or fire-retardant insulation. Thus, in FIG. 2, outer rear wall 12 has a corresponding outer surface 12*a* and an inner surface 12*b*. Correspondingly, outer right wall 8 has outer surface 8*a* and inner surface 8*b* and outer left wall 10 has outer surface 10*a* and inner surface 10*b*. Fire-retardant insulation 11 may be packed between any wall inner surface and outer surface. While not shown in the drawings, outer top wall 4 and outer bottom wall 6 also have an inner and outer surface separated by dead air space or fire-retardant insulation.

Figure 2:
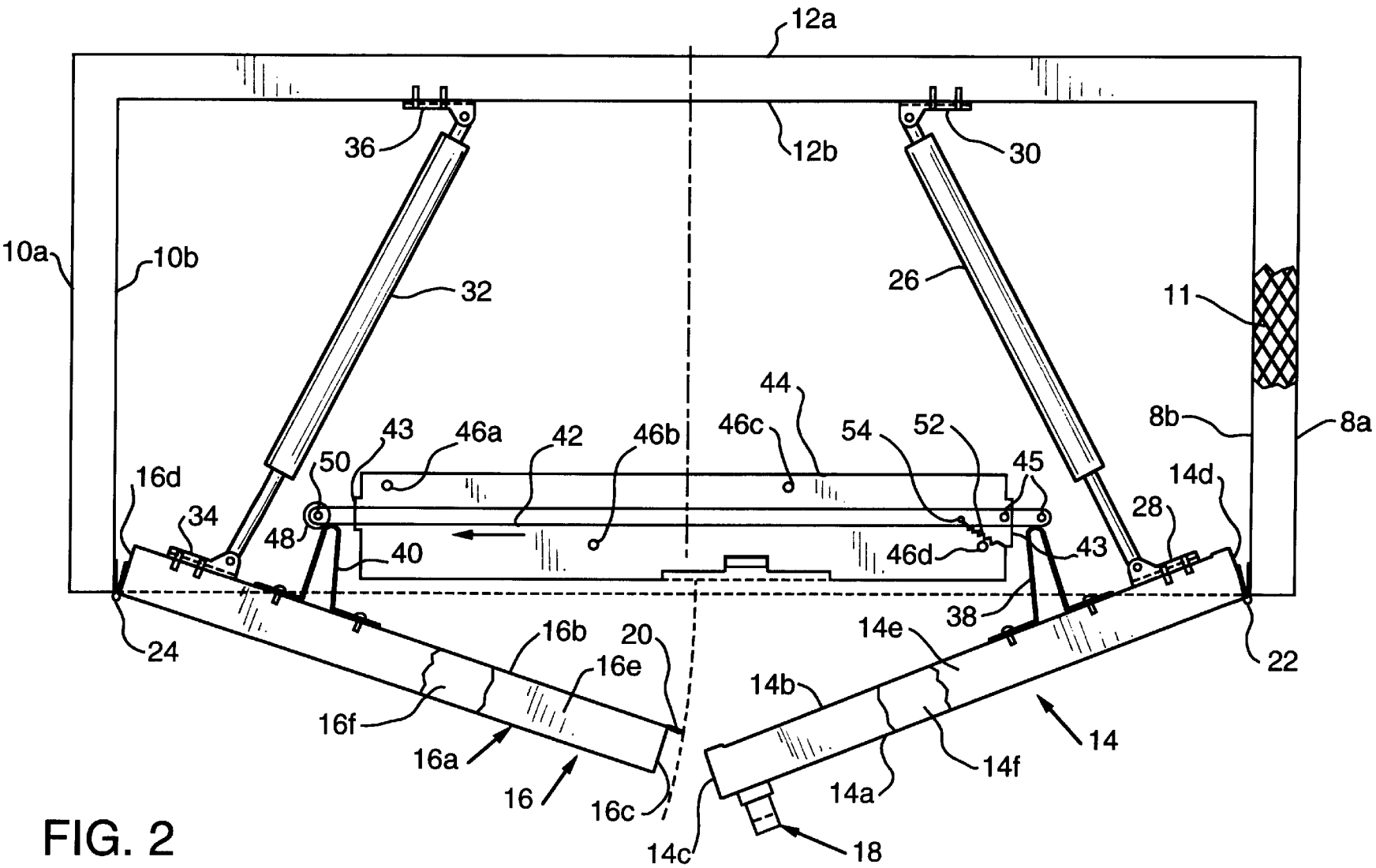
FIG. 2 is a top view of a cabinet self-closing and sequencing mechanism with the right door stopped until the left door closes.

As best seen in FIG. 2, the front of cabinet 2 is closed off by right door 14 and left door 16 with both doors having a similar double wall construction. Outer surface 14*a* of right door 14 is separated from inner surface 14*b* by side walls 14*c*, 14*d*, 14*e* and 14*f* (bottom surface 14*f* is shown in the cut-away portion of FIG. 2) defining an enclosed dead air space. Left door 16 is of similar construction, with side walls 16*c*, 16*d*, 16*e* and 16*f* (bottom surface 16*f* is shown in the cut-away portion of FIG. 2) joining outer surface 16*a* and inner surface 16*b*.

In the embodiment illustrated in FIG. 2, left door 16 has sealing flange 20 protruding along side wall 16*e*. Because sealing flange 20 protrudes from surface 16*e* along the side closest to the interior of safety cabinet 2, left door 16 must close before right door 14 so that the safety cabinet doors 14 and 16 close tightly and are flush with the outside edges of safety cabinet 2. Alternatively, sealing flange 20 could protrude from surface 16*e* along the side closest to the exterior of safety cabinet 2 and even still, left door 16 must close before right door 14.

Right door 14 is hingedly mounted to outer right wall 8 by hinge 22. Likewise, left door 16 is hingedly mounted to outer left wall 10 by hinge 24. In the preferred embodiment of the present invention hinges 22 and 24 run the length of the respective doors along edges 14*d* and 16*d*.

When doors 14 and 16 are closed, safety cabinet 2 defines an inner protected air space surrounded top, bottom, sides, back and front by double-walled elements having insulating spaces created therebetween. It is contemplated that articles placed within safety cabinet 2 will be protected from the effects of fire when said doors 14 and 16 are closed.

An automatic door closing mechanism 26 is mounted to the inner surface 14*b* of right door 14 by mount 28. Right door closing mechanism 26 extends from inner surface 14*b* of right door 14 to inner surface 12*b* of outer rear wall 12 where it is mounted by mount 30. Right door closing mechanism 26 is pivotally mounted on both mounts 28 and 30. Door closing mechanism 26 is positioned close to the inner surface of outer top wall 4 so that it does not interfere with the interior space of safety cabinet 2. Similarly, left door closing mechanism 32 is attached to inner surface 16*b* of left door 16 by left door mount 34. Door closing mechanism 32 extends from left door 16 to outer rear wall 12. It is mounted to outer rear wall 12 by rear wall mount 36. Again, left door closing mechanism 32 is pivotally mounted on both mounts 34 and 36 so that it may move when left door 16 is opened and closed. Left door mechanism 32 is also positioned close to the inner surface of outer top wall 4 so that it does not consume valuable space in the interior of safety cabinet 2.

Automatic door closing mechanisms 26 and 32 may be of any known type of door closing mechanism such as pneumatic, hydraulic or mechanical self-closing devices. In the preferable embodiment, automatic closing mechanisms 26 and 32 are hydraulic closing mechanisms.

A fusible linking device (not shown) may also be connected to each door 14 and 16. These heat sensitive devices can hold doors 14 and 16 in an open position and in the event of a high temperature hazard, the fusible links will melt allowing doors 14 and 16 to close.

During any automatic closing of doors 14 and 16, it is necessary that the doors close in sequence wherein left door 16 reaches a closed position prior to right door 14. This sequence must be maintained because of the protrusion of sealing flange 20 on surface 16*e* of left door 16.

A preferred embodiment to sequence the closing of doors 14 and 16 includes a fixedly-mounted, stationary, one-piece right door stop bracket 38. Right door stop bracket 38 is positioned on inner surface 14*b* of right door 14 adjacent to top surface 14*c*. The one-piece stop bracket 38 is also positioned near the midpoint of the length of door 14 and preferably closest to surface 14*d* which is closest to the side hinged by hinge 22 to outer right wall 8. Stop bracket 38 may be of a simple right-triangular shape and is made of metal in its preferable form. Metal provides a durable construction for stop bracket 38. Stop bracket 38 may be of solid or hollow construction.

As part of the sequencing mechanism, mounted on left door 16 is a fixedly-mounted, stationary, one-piece left door cam bracket 40. Cam bracket 40 has a cam shape and is preferably made of a durable material like metal. Cam bracket 40 may be of solid or hollow construction. Single piece cam bracket 40 is mounted on inner surface 16*b* of left door 16 adjacent to top surface 16*c* and close to the midpoint of the length of left door 16 and preferably between the midpoint and edge 16*d*.

Operably associated with single piece right door stop bracket 38 and single piece left door cam bracket 40 is slide bar 42, the third component of the sequencing mechanism of the preferred embodiment of the present invention. Slide bar 42 is slidably mounted on slide bar mount 44 which is mounted by rivets or screws 46*a*, 46*b*, 46*c* and 46*d* to the inner surface of outer top wall 4. Slide bar 42 is mounted such that it is free to slide left and right in guide openings 43 of slide bar mount 44. The right end of slide bar 42 can be bare or fitted with stoppers 45. Stoppers 45 may be placed, as shown, on slide bar 42 to restrict the motion of slide bar 42. On the left end of slide bar 42 is rotating roller 48 attached to slide bar 42 by roller axle 50. The diameter of roller 48 is typically larger than the width of slide bar 42. Roller 48 may be made of any durable wear-resistant material, preferably nylon.

When doors 14 and 16 are both in the open position, slide bar 42 remains in a relaxed position by the action of a biasing spring 52 which is connected at one end to slide bar mount 44 by biasing spring connection 54 and to slide bar 42 at the other end. The relaxed position of slide bar 42 is shown in FIG. 2. In the relaxed position, slide bar 42 would come in physical contact with both stop bracket 38 and cam bracket 40.

When doors 14 and 16 are held open, and slide bracket 42 is positioned in its rightward most attitude, slide bar 42 will be positioned as shown FIG. 2. The bare end of slide bar 42 will protrude into the path of right door stop bracket 38 so that the closing of right door 14 will be arrested by slide bar 42.

Figure 3:
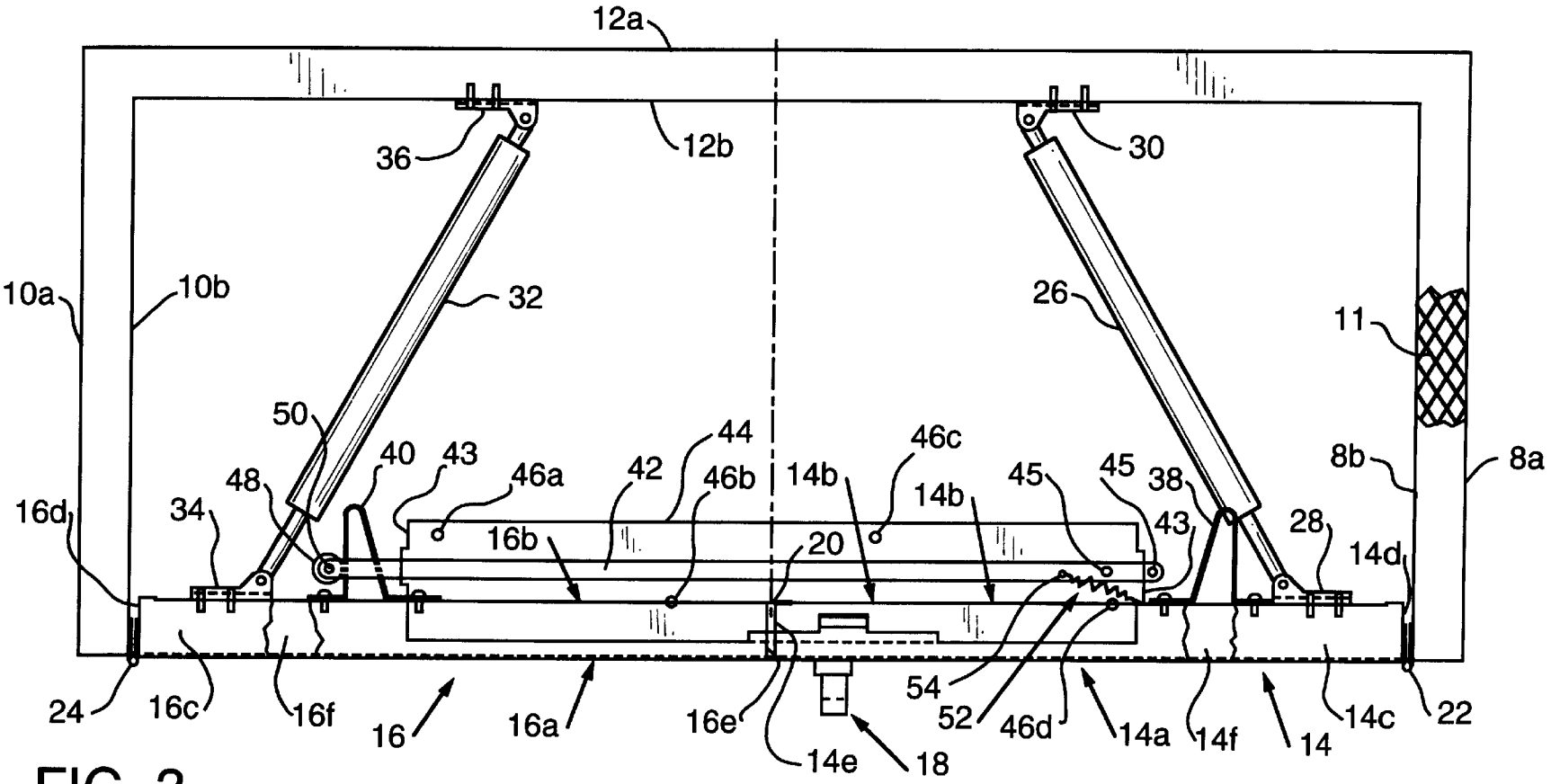
FIG. 3 is a top view of a cabinet self-closing and sequencing mechanism with both cabinet doors closed.

As best illustrated in FIGS. 2 and 3, right door 14 will remain partially open until slide bracket 42 moves leftward a sufficient distance to remove slide bar 42 from the path of stop bracket 38. Such a position is illustrated in FIG. 3.

Movement of slide bar 42 is accomplished as follows: When left door 16 closes, cam bracket 40 comes in contact with roller 48. Sufficient force is exerted on roller 48 by the closing of left door 16 so that roller 48 moves along the cam-shaped surface of cam bracket 40 causing the expansion of spring 52 and the movement of the slide bar 42 to the left. When roller 48 completes its movement along cam bracket 40, slide bar 42 will be completely removed from the path of stop bracket 38, thus allowing right door 14 to close so that outer surface 14*a* is flush with outer surface 16*a* of left door 16. In this manner, it is assured that door 16 with sealing flange 20 will close fully before right door 14 thus providing a protective seal for safety cabinet 2.

Figure 4:
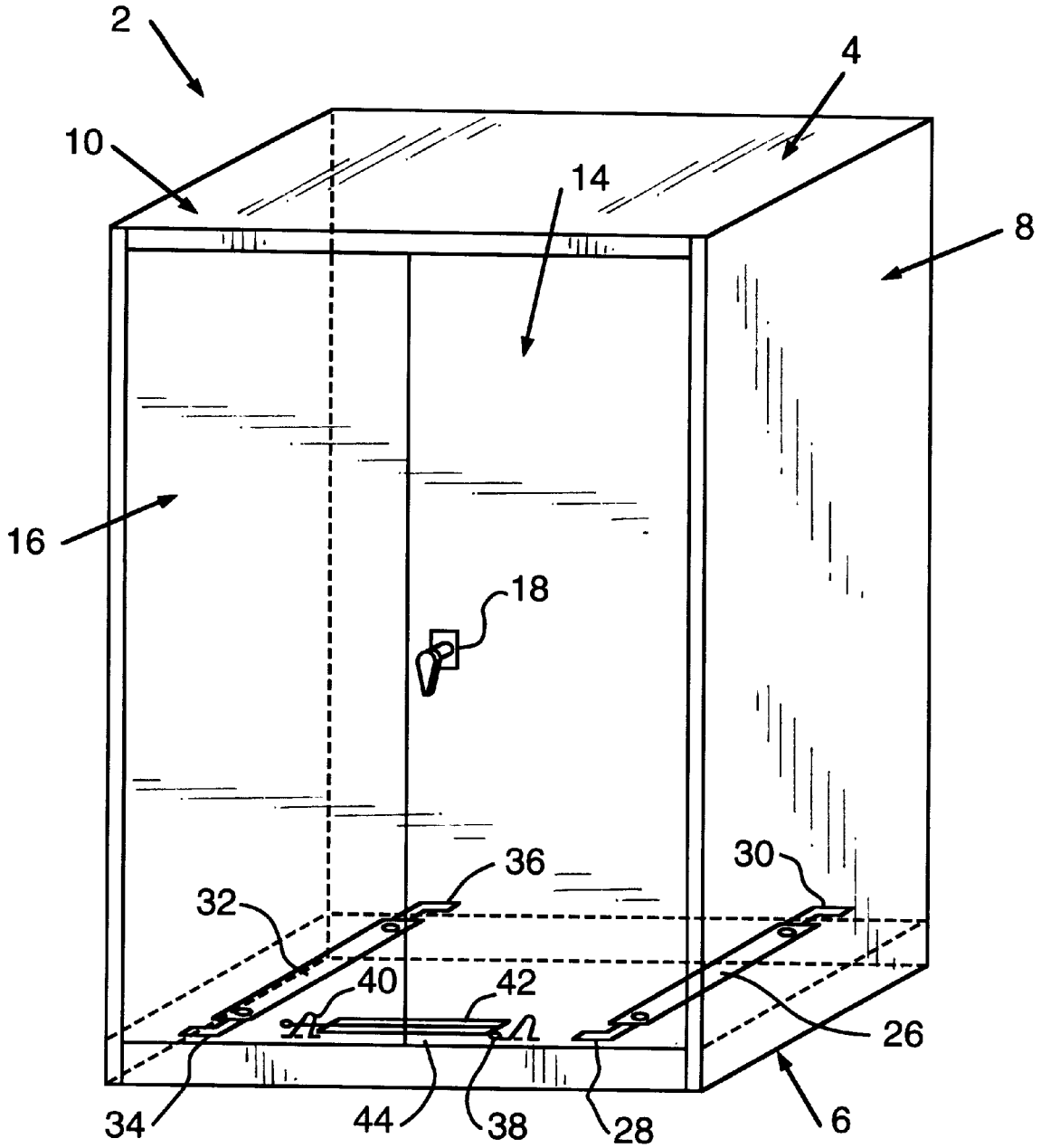
FIG. 4 is a view of another embodiment of the present invention.

A second embodiment of the present invention, illustrated in FIG. 4, relates particularly to a closing device which is mounted at the inner surface of outer bottom wall 6. The three components of the door sequencing means, namely single piece stop bracket 38, single piece cam bracket 40 and slide bar 42 may be mounted at the bottom of safety cabinet 2. Stop bracket 38 and cam bracket 40 will be located at the bottoms of doors 14 and 16 respectively. Slide bar 42 will be mounted at the bottom of the inner surface of outer bottom wall 6. All three components will be operably associated with each other, as previously described, such that door 16 with sealing flange 20 closes prior to door 14. A shelf (not shown) may be placed just above the door sequencing mechanism to keep the device clear of obstruction.

While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

What is claimed is:

1. A safety cabinet having a top wall, a bottom wall, two side walls, a rear wall and an open front, a first door hingedly mounted to one side wall, at an end opposite said rear wall, having an interior face and a sealing flange extending therefrom;

a second door hingedly mounted to the other side wall, at an end opposite said rear wall, having an interior face;

an automatic door closing mechanism on each of said first door and said second door extending from the interior face of each door and adapted to close said door;

a cam-shaped bracket mounted on the interior face of said first door between a midpoint of the length of said first door and an edge which is hingedly mounted on a side wall;

a stop bracket mounted on the interior surface of said second door positioned between a midpoint of the length of said second door and an edge which is hingedly mounted on the other side wall; and a slide bar movably mounted on an inside surface of said top wall, adjacent said open front movably secured thereto, and having a roller attached, said slide bar in rest position blocking closure of said second door by contact with said stop bracket, whereby upon closure of said first door, the cam-shaped bracket contacts said roller and moves the slide bar out of the path of said stop bracket allowing said second door to close and abut said flange.

2. The safety cabinet of claim 1, wherein said automatic door closing mechanisms are mounted on the interior face of each door and the rear wall of the safety cabinet.

3. The safety cabinet of claim 1, wherein said automatic door closing mechanisms are hydraulic door closing mechanisms.

4. The safety cabinet of claim 1, wherein said roller on said slide bar is made of nylon.

5. The safety cabinet of claim 1, wherein said stop bracket is made of metal.

6. The safety cabinet of claim 1, wherein said cam shaped bracket is made of metal.

7. The safety cabinet of claim 1, wherein a space between an inner and an outer surface of each of the top, bottom and side walls is filled mostly with air.

8. The safety cabinet of claim 1, wherein a space between an inner and an outer surface of each of the top, bottom and side walls is filled with fire retardant insulation.

9. A safety cabinet having a top wall, a bottom wall, two side walls, a rear wall and an open front, a first door hingedly mounted to one side wall, at an end opposite said rear wall, having an interior face and a sealing flange extending therefrom;

a second door hingedly mounted to the other side wall, at an end opposite said rear wall, having an interior face;

an automatic door closing mechanism on each of said first door and said second door extending from the interior face of each door and adapted to close said door;

a cam-shaped bracket mounted on the interior face of said first door between a midpoint of the length of said first door and an edge which is hingedly mounted on a side wall;

a stop bracket mounted on the interior surface of said second door positioned between a midpoint of the length of said second door and an edge which is hingedly mounted on the other side wall; and a slide bar movably mounted on an inside surface of said bottom wall, adjacent said open front movably secured thereto, and having a roller attached, said slide bar in rest position blocking closure of said second door by contact with said stop bracket, whereby upon closure of said first door, the cam-shaped bracket contacts said roller and moves the slide bar out of the path of said stop bracket allowing said second door to close and abut said flange.

* * * * *